US005492092A

United States Patent [19]

Benson

[11] Patent Number: 5,492,092

[45] Date of Patent: Feb. 20, 1996

[54] SNOW MOBILE ENGINE HEAD

[76] Inventor: Steven R. Benson, 5919 S. 350 West, P.O. Box 57547, Murray, Utah 84107

[21] Appl. No.: 407,118

[22] Filed: Mar. 20, 1995

[51] Int. Cl.[6] ..... F02F 11/00

[52] U.S. Cl. ..... 123/193.5; 123/664

[58] Field of Search ..... 123/193.3, 193.5, 123/262, 309, 657, 661, 663, 664, 665, 666

[56] References Cited

U.S. PATENT DOCUMENTS

| | | | |
|---|---|---|---|
| 2,504,243 | 4/1950 | Anderson | 123/664 |
| 2,855,911 | 10/1958 | Christiasen | 123/193.3 |
| 4,494,491 | 1/1985 | Takad et al. | 123/193.3 |
| 4,881,513 | 11/1989 | Hamanaka | 123/664 |
| 5,125,375 | 6/1992 | Vuk | 123/193.5 |
| 5,211,153 | 5/1993 | Yonekawa et al. | 123/193.3 |
| 5,372,105 | 12/1994 | Nagao et al. | 123/661 |

*Primary Examiner*—Marguerite Macy
*Attorney, Agent, or Firm*—M. Reid Russell

[57] ABSTRACT

The invention in a snow mobile engine head is formed, as by milling methods, from an aluminum billet and includes spaced bolt bosses extending at spaced intervals from around the head perimeter, each of which bolt bosses includes a hole formed therethrough to receive a bolt that is turned into an engine block, mounting the head. The head includes a firing chamber formed therein in opposition to a piston chamber formed in the engine block, for containing a piston having a crown top surface with a junction of an outer edge of the firing chamber and an edge of an inner wall of a head squish band radiused to provide a curved surface thereat that will encourage a circular flow of an air fuel mixture towards the head firing chamber center to provide for improved exhaust gas acceleration away from the piston outer perimeter, aiding in the eliminate detonation. The head bolt bosses each include a stepped section formed in the ends thereof for registering to, and receiving head openings of a water distribution plate fitted thereto, which head includes a center plug seat formed through the head crown that is thread to receive a spark plug. A resilient high temperature O-ring seal is fitted to the plug seat for sealing in a plug hole that is formed through an engine cover, and each head top surface is preferably formed with radially stepped surfaces to essentially double the head surface area for increasing cooling efficiency.

6 Claims, 4 Drawing Sheets

SNOW MOBILE ENGINE HEAD

BACKGROUND OF THE INVENTION

1. Field of the Invention

This invention relates to engine heads and in particular to high performance heads suitable for use in snow mobile type engines.

2. Prior Art

Engine heads, and heads for snow mobile type naturally aspirated and turbo charged engines are in common use and even heads milled from billet aluminum that include cooling fins are not new. Prior to the present invention, however, the inner piston opposing surfaces of available heads have failed to impart, by their design, a circular mixing motion to an air fuel mixture entering the engine combustion chamber to flow toward the center of the piston crown and for accelerating end or exhaust gases away from the piston outer perimeter to help to eliminate unwanted detonation. To provide a thorough mixing of the fuel air mixture, the invention radiuses the junction of the head squish band with the head surface that opposes the piston crown, providing a curved surface that encourages both mixing of the fuel air mixture flow and the acceleration of end or exhaust gas produced from burning of the fuel air mixture. The radiused surface encourages the fuel air mixture to circulate towards the center of the piston crown, to, in conjunction with the upward travel of the piston, produce an increase in turbulence as compared to earlier head configurations. This results in improved fuel atomization that causes a more complete fuel burning to thereby produce more power from a same volume of fuel than has been possible with earlier heads.

Applications for U.S. Design Patents have been made on two embodiments of engine heads of the invention, set out in U.S. Design patent applications Ser. Nos. 29/028,855 and 29/028,856 both filed Sep. 23, 1994.

Summary of the Invention

It is a principal of the present invention in a snow mobile engine head to provide an engine head for a two stroke engine, such as an engine that is for installation in a snow mobile, which engine head is radiused around a junction of a head dome edge with a head squish band section that is the head inner surface opposite to the piston crown, to encourage a fuel air mixture injected into the engine to travel in a circular motion towards the center of the piston crown creating, with an upward travel of the piston towards the head, a turbulent fuel air flow that improves fuel atomization and promotes fuel burning.

Another object of the present invention in a snow mobile engine head is to provide an engine head that has a radiused squish band junction to the dome of the head inner surface that is opposite to the piston crown to help to accelerate end gases away from the piston outer perimeter and to discourage detonation.

Another object of the present invention in a snow mobile engine head is to provide a head that is formed to have a number of cooling ridges over its outer or top surface for increasing cooling efficiency.

Still another object of the present invention in a snow mobile engine head is to provide a water distribution plate for location within an engine cover and in registry with the engine head whereby a coolant flow through the engine cover is directed across the engine head so as to provide an even temperature distribution around a plug seat formed in the engine head for improved engine reliability and performance.

Still another object of the present invention in a snow mobile engine head is to provide an arrangement of a sealing O-ring for a cover seal mount that is formed in the engine head, with the O-ring seal for fitting through in a hole in the engine cover, to prevent leakage therearound.

Still another object of the present invention in a snow mobile engine head is to provide an engine head configuration that can be conveniently machined from an aluminum billet In accordance with the above objects the present invention is in a snow mobile engine head that is preferably milled from an aluminum billet to include, as progressively larger diameter rings in a top surface, a plurality of ridges formed therein. The formed ridges essentially double the head surface area to dissipate heat into a coolant flow thereover, providing an improved head cooling. The engine head is for use with a water distribution plate that is fitted to extend across the inside of an engine cover. The engine head includes identical flat stepped sections that each are formed across a mounting arm of the head engine block engaging surfaces. The flat stepped section are to receive and provide a registry with edges of a hole that is formed the water distribution plate. A recessed seating of the water distribution plate in the engine head is thereby provided for both facilitating fitting the engine head to the water distribution plate and for improving water circulation over the engine head upper or top surface. The improved water circulation, during engine operation, provides for an even temperature around plug seats formed in each engine head for improving engine reliability and performance.

The head of the invention is arranged to receive an improved O-ring seal arranged for fitting onto the head plug seat and is preferably formed from a high temperature Viton™ type material. The O-ring seal provides a reliable high pressure seal by compressing and sealing between the plug seat and an edge of a plug hole that has been formed through the engine cover. The O-ring is arranged to be close fitting when compressed so as to not require an application of a silicone sealant material thereto to provide sealing, and is resistive to being cut during use, allowing it to be reused as needed.

The engine head of the invention includes a unique piston dome opposing surface that is configured to provide for both accelerating end or exhaust gases away from the piston outer perimeter and towards the plug seat so as to aid in an eliminate of premature detonation, and for forcing the air fuel mixture to circulate within the firing chamber in a circular motion towards the center of the piston crown. A turbulent fuel air mix flow is thereby provided that exhibits improved fuel atomization resulting in a better fuel burn, for a greater energy production than has been achieved with earlier head designs.

A major improvement in the engine head of the invention is in a radiusing of the junction of the engine head firing chamber dome edge with the engine head squish band. This radiusing is as curved as possible for the particular piston crown opposing surface, and eliminates a corner as was present in earlier heads.

THE DRAWINGS

The following drawings illustrate that which is presently regarded as the best mode for carrying out the invention:

Figure 1:
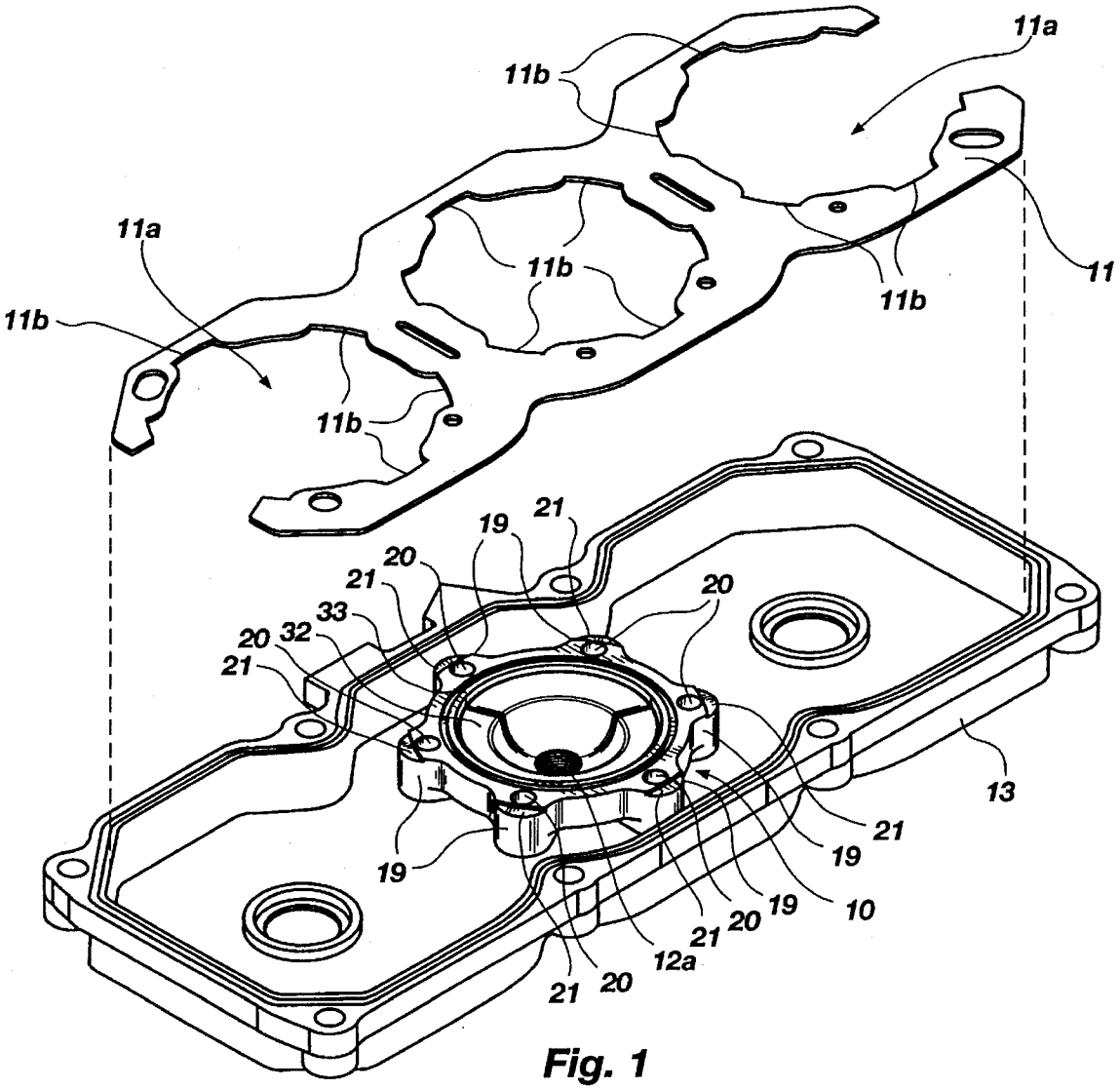
FIG. 1 is a bottom plan perspective view of snow mobile engine head of the invention fitted to an engine cover and with a water distribution plate exploded away from the engine head.
Figure 5:
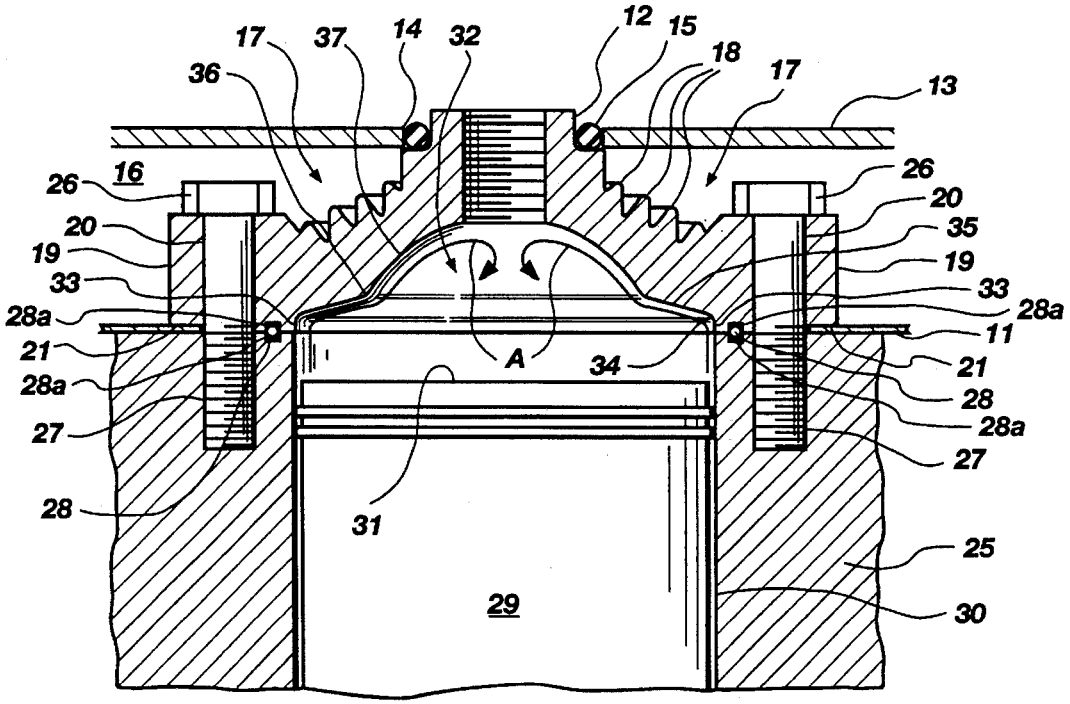
Figure 6:
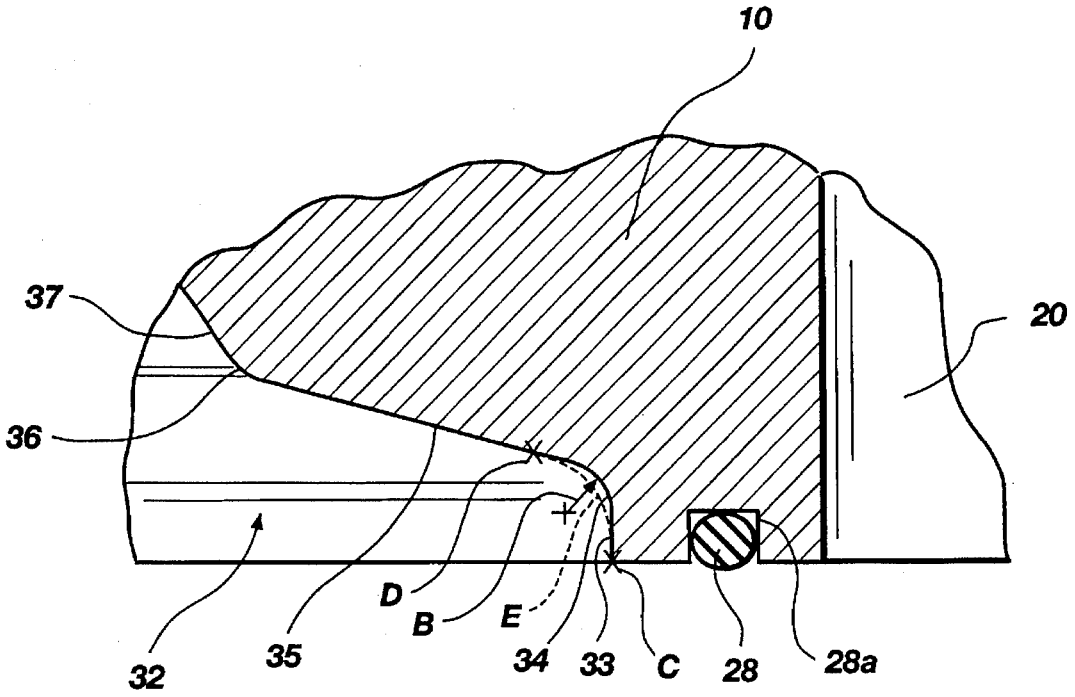

FIG. 5 is an enlarged side elevation sectional view of the engine head of the invention shown installed onto an engine block wherein a piston is arranged in an engine block cylinder, showing the water distribution plate of FIG. 1 sandwiched between the engine head and the top of the engine block and showing the cover fitted to the engine head; and FIG. 6 is a enlarged view of a section of the engine head of FIG. 5 taken on one side of the engine head of FIG. 5 illustrating a radiusing of the junction of the engine head firing chamber dome edge and squish band.

DETAILED DESCRIPTION

Figure 2:
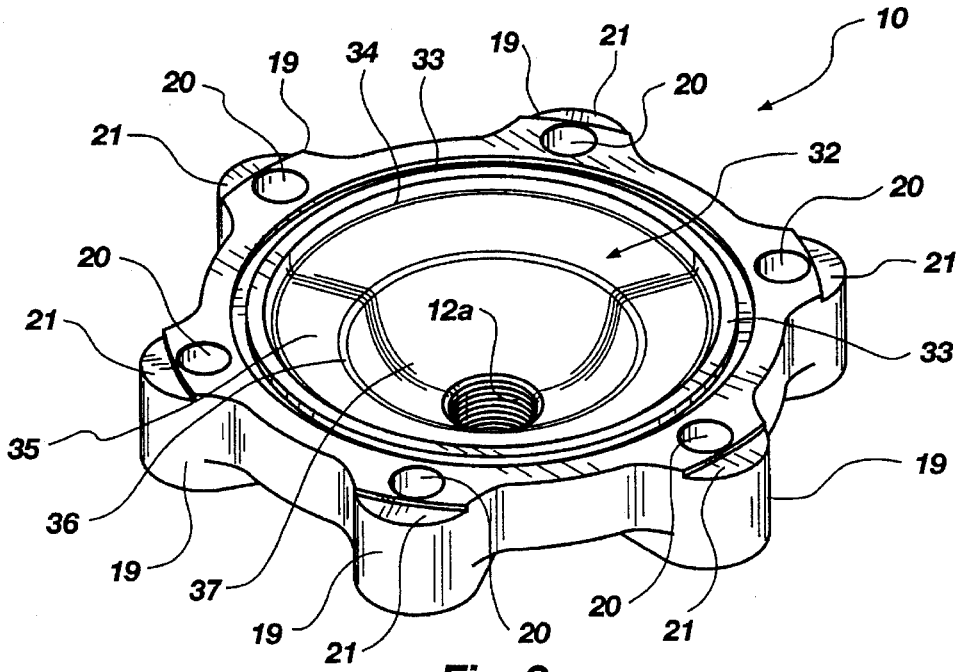
FIG. 2 is an enlarged profile perspective view of the engine head of FIG. 1 removed from the engine cover.

FIG. 1 shows a snow mobile engine head 10 of the invention, hereinafter referred to as head, for fitting onto an engine block wherein a piston is arranged to travel. During piston travel a top or crown of the piston opposes a firing chamber or dome of the head that has a concave surface, is with a spark plug seat 12 is formed in the head center. A water distribution plate 11 is shown exploded out of engagement with the head 10 that is shown fitted to an engine cover 13. In the arrangement, the head plug seat 12, as shown in FIG. 5, fits through a plug seat hole 14 formed through the engine cover 13. The plug seat 12 is shown as including a threaded plug hole 12*a* formed therethrough. An O-ring 15 is shown in FIGS. 2 and 5 fitted around the head plug seat 12. The O-ring 15 is preferably formed from a resilient material, such as a Viton™ type material that is suitable for maintaining seal integrity when subjected to a flow of hot water thereover. Viton™ material is capable of retaining its stability at high temperature and has been found to be stable as a material of forming the O-ring seal to providing for proper sealing of the head spark plug seat 12 in the engine cover hole 14. The O-ring 15 fitted around the head plug seat 12, shown in FIG. 5 and will compress to fit tightly against both the head plug seat and the edge of the engine cover hole 14 for prohibiting leakage of cooling water that is pumped through area 16 between the engine cover 13 and a head top surface 17.

Figure 3:
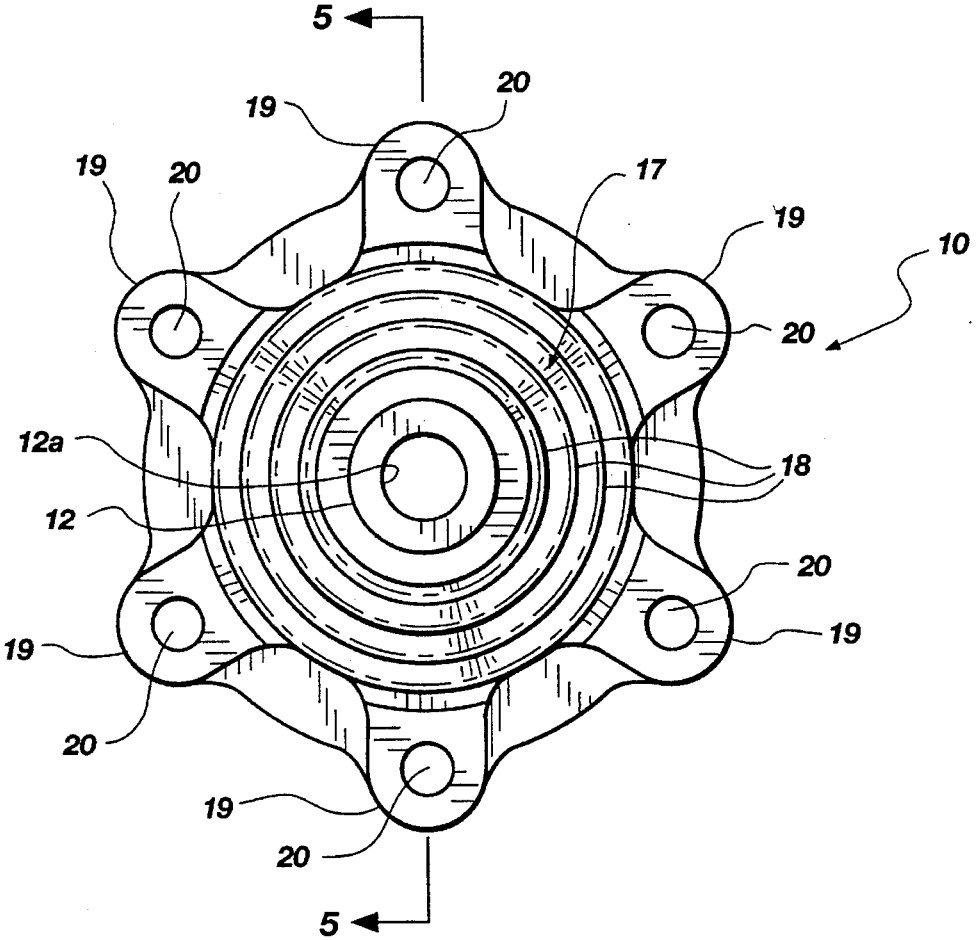
FIG. 3 is a top plan view of the engine head of FIG. 2.
Figure 4:
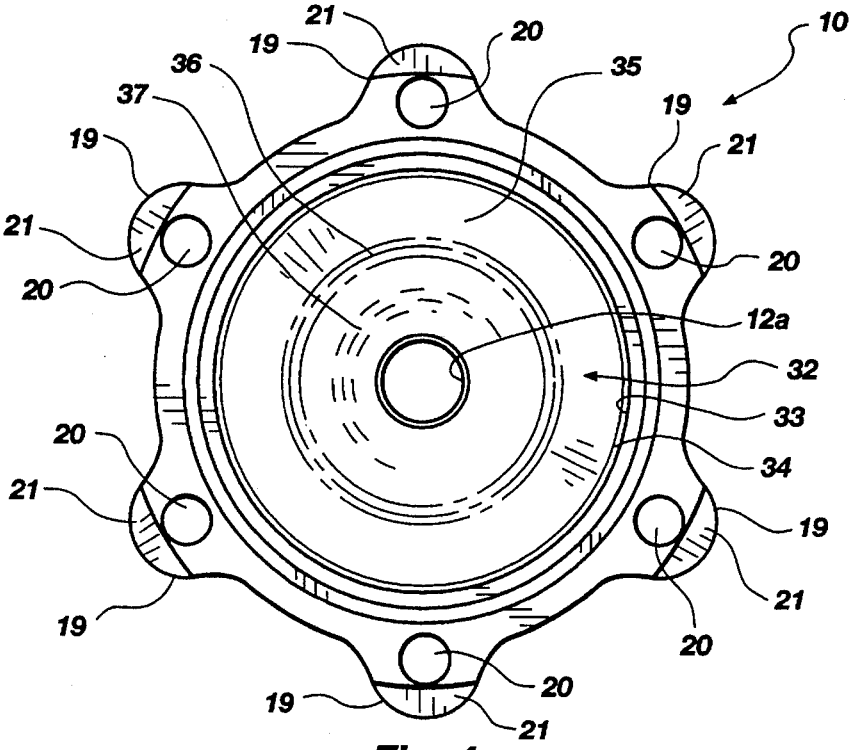
FIG. 4 is a bottom plan view of the engine head of FIG. 2.

To provide for an improvement in cooling efficiency, the head top surface 17, as shown in FIGS. 3 and 5, is preferably provided with a series of successively greater diameter stepped ring segments 18 from the plug seat 12 to the head outer edge, adjacent to bolt bosses 19. The ring segments 18 are formed in the top surface to ascend from inner edges of ends of the spaced bolt bosses 19 that are formed to extend at spaced intervals from around the head outer edge. The stepped ring segments 18 provide for increasing the area of the head top surface, such that, as the cooling water flows thereover, improved cooling of the head and head plug seat is provided. In practice, the stepped ring segments 18 are approximately twice the area of a flat head top surface 17.

The spaced bolt bosses 19 each include a center bolt hole 20 formed therethrough and, as shown in FIGS. 1, 2, 4 and 5, each boss 19 includes a recess 21 formed across its outer perimeter that is for receiving a section 11*b* of the water distribution plate 11. The sections 11*b* are formed at spaced intervals in a head opening 11*a* that is formed through the water distribution plate 11, as shown best in FIG. 1. The water distribution plate 11 is thereby maintained in registry with the head 10 as it is fitted onto a top surface of an engine block 22, as shown in FIG. 5. Three head openings 11*a* are shown formed through the water distribution plate in FIG. 1, each for accommodating a head 10 of the invention.

The head 10 of the invention is shown in FIG. 5 mounted onto an engine block 25 with bolts 26 that have been fitted through the bolt bosses 19 holes 20 and are turned into threaded engine block holes 27. An O-ring seal 28 is shown fitted in opposing slots 28*a* that are provided between the head 10 and engine block 25. A piston 29 is shown fitted to travel up and down in a cylinder 30 of the engine. Each piston 29 includes a piston crown surface 31 that opposes a curved dome or open area of a head piston opposing surface 32, with the piston crown surface 31 being the top of the engine firing chamber. The piston crown is the bottom of the firing chamber. The O-ring seal 28 is adjacent to a head squish band 33 section that extends, essentially at a right angle upwardly, from the head engine block engaging surface wherein slot 28*a* is formed that the O-ring seal 28 is fitted in. A junction of a sloping outer surface 35 of the head piston opposing surface 32 is shown in FIGS. 5 and 6, as radiused at a junction 34 between the sloping outer surface 35 edge and squish band 33. In earlier heads, this junction has been formed, by essentially a meeting of straight surfaces at an angle junction to present a corner that gases within the engine firing chamber have been trapped in. Such trapped gases interfere with air fuel mixing, burning and end or exhaust gas flows. By providing radiusing of the junction between the squish band 33 inner surface and the edge of sloping outer surface 35 a curved flow path to the gases is provided. This radiused or curved surface promotes acceleration of end or exhaust gases away from the outer perimeter of the piston crown surface 31 thereby eliminating hot spots and discouraging detonation of an incoming air fuel mixture. A curved flow path is thereby provided to the incoming air fuel mixture that forces the air fuel mixture along the sloping outer surface 35, that is preferably straight, with that flow changing direction at junction 36 and will travel along surface 37, creating a circular gas flow. The flow is thereby directed towards the center of the piston crown surface 31. The circular motion of the flow of air fuel mixture, in conjunction with the upward travel of the piston crown surface 31, creates an enhanced turbulence, shown as arrows A in FIG. 5, within the head chamber between the head piston opposing surface 32 and the piston crown surface 31. This turbulent flow provides for an improvement in fuel atomization over earlier heads, and produces a greater power output from a same volume of fuel than has formerly been achieved.

As set out above, the head piston opposing surface 32 of the invention is radiused at 34 to present a curved cornerless surface to both an end or exhaust gas outlet flow and an inlet flow of an air fuel mixture. This curved surface promotes turbulence in the air fuel flow that results in improved fuel atomization. In practice, the radiused surface has a minimum radius of one sixteenth (1/16) inch, illustrated as arrow B in FIG. 6, that extends from a cross to the radiused surface 34 and may extend, as a curved surface, between the bottom of the squish band 33, shown as an X identified as C, to a point along the sloping outer surface shown as an X identified as D, with the arc therebetween identified as broken lines E. The arc of radiused surface 34 is dependent piston crown surface 31 configuration of piston 29 and, it is preferred to have a greatest arc possible for a particular piston. The radiused surface 34, in practice, presents a sufficient curve to create the flow improvements within the firing chamber 32. A length of radius of one sixteenth (1/16) of an inch is selected for a small size of head 10, and is preferably greater for larger heads within the scope of this disclosure.

While a preferred embodiment of my invention in a snow mobile engine head has been shown and described herein, it should be understood that the present disclosure is made by way of example only and that variations and changes thereto are possible without departing from the subject matter coming within the scope of the following claims, and a reasonable equivalency thereof, which claims I regard as my invention.

I claim:

1. A snow mobile engine head comprising, a head formed as a single unit that includes a threaded plug seat formed in said head center, and includes a plurality of spaced bolt bosses extending at equal intervals from around a head periphery that each include a hole formed therethrough for receiving a bolt for fastening said head onto an engine block whereby said head covers a piston chamber wherein an engine piston is arranged, which said head includes a head piston opposing surface for positioning opposite to a piston crown surface, and said head piston opposing surface includes a squish band formed around an outer edge thereof having a face for engaging said engine block surface adjacent to said piston chamber with a junction of an upstanding wall of said squish band and an outer edge of said head piston opposing surface that intersect at greater than a right angle and is radiused, utilizing at least a one sixteenth (1/16) of an inch radius, forming a curved surface at said intersection.

2. A snow mobile engine head as recited in claim 1, wherein a top surface of the head is stepped at radial intervals from adjacent to the bolt bosses to an outer surface of the plug seat substantially increasing the surface area of said head top surface over a flat surface.

3. A snow mobile engine head as recited in claim 1, wherein the bolt bosses are each stepped downwardly from the plane of said bolt boss undersurface into flat sections for registering with and receiving edges of an opening formed through a water distribution plate to receive the head fitted therein.

4. A snow mobile engine head as recited in claim 1, wherein the plug seat receives an O-ring formed from a resilient seal material fitted thereover for sealing in a plug seat hole formed through an engine cover.

5. A snowmobile engine head as recited in claim 1, wherein the head piston opposing surface is formed by a surface that extends from a junction with the plug seat to a junction with a downwardly sloping outer surface whose outer edge is radiused at its junction with the squish band upstanding wall.

6. A snowmobile engine head as recited in claim 1, wherein the engine head is formed by machining methods from a single aluminum billet.

* * * * *